United States Patent [19]

Lorant

[11] Patent Number: 4,499,727

[45] Date of Patent: Feb. 19, 1985

[54] HOT GAS ENGINE

[75] Inventor: Stefan Lorant, Oxie, Sweden

[73] Assignee: United Stirling AB, Sweden

[21] Appl. No.: 479,469

[22] Filed: Mar. 28, 1983

[51] Int. Cl.[3] ..... F02G 1/04
[52] U.S. Cl. ..... 60/525; 60/517
[58] Field of Search ..... 60/517, 525; 62/6

[56] References Cited

U.S. PATENT DOCUMENTS

| | | | |
|---|---|---|---|
| 3,822,552 | 7/1974 | Palmgren | 60/517 |
| 3,890,785 | 6/1975 | Torsten | 60/525 |
| 4,261,172 | 4/1981 | Bratt et al. | 60/525 |
| 4,261,173 | 4/1981 | Lorant | 60/525 |
| 4,330,994 | 5/1982 | Rosenqvist | 60/525 |

FOREIGN PATENT DOCUMENTS

| | | | |
|---|---|---|---|
| 1330619 | 9/1973 | United Kingdom | 60/525 |

OTHER PUBLICATIONS

"United Stirling" brochure, dated 1977.

*Primary Examiner*—Stephen F. Husar
*Attorney, Agent, or Firm*—Finnegan, Henderson, Farabow, Garrett & Dunner

[57] ABSTRACT

In a hot gas engine of the type in which a number of working gas charges are separated from each other by an equal number of pistons each mounted slidably in a cylinder the said pistons are forming pairs each pair being connected to a common crank shaft so as be angular displaced in their movements relative pistons in adjacent cylinders. Each cylinder has a variable volume chamber connected to a variable volume chamber of an adjacent cylinder and all cylinders are interconnected.

4 Claims, 9 Drawing Figures

HOT GAS ENGINE

BACKGROUND OF THE INVENTION

1. Field of the Invention

The present invention relates to a hot gas engine of the type in which each of a plurality of working gas charges is oscillated between variable volume chambers of different temperatures so as to perform working cycles each of which consists of a compression in a low temperature variable volume chamber, a displacement to a high temperature variable volume chamber, an expansion in said high temperature chamber and a displacement back to said low temperature chamber, said engine comprising a plurality of cylinders, each of which contains a piston separating two working gas chambers and being connected to a common crank shaft.

2. Description of the Prior Art

Hot gas engine of the above type are commonly known from e.g. the U.S. Pat. Nos. 4,261,172 and 4,261,173. A basic explanation of the engine is found in the pamphlet entitled United Stirling which was distributed in the United States in 1977.

More powerful engines may be provided by connecting units of engines. This has been disclosed in the U.S. Pat. Nos. 3,882,552 and 4,330,994.

However, hitherto it has not been possible to connect more than six cylinders in a unit and it has not been possible to connect two or more units without use of multiple heating devices requiring the use of separate governing systems for heat supply or air-fuel ratio.

OBJECT OF THE INVENTION

The object of the present invention to provide a hot gas engine having more than six cylinders but only one heating system.

SUMMARY OF THE INVENTION

This object is obtained, according to the invention, by providing the engine with the following features in combination

- all cylinders are series connected to form a loop, each low temperature variable volume chamber being connected to the high temperature variable volume chamber of a neighboring cylinder via a cold gas connecting duct, a cooler, a regenerator and a heater
- the pistons are arranged in pairs of two, the two pistons of each pair performing identical simultaneous travels in their cylinders that is, being at essentially the same positions in the respective cylinders at any given time in the working cycle
- the pairs of pistons are equally angularly displaced in their cyclical travel in the cylinders.

DETAILED DESCRIPTION OF THE DRAWINGS

Figure 1:
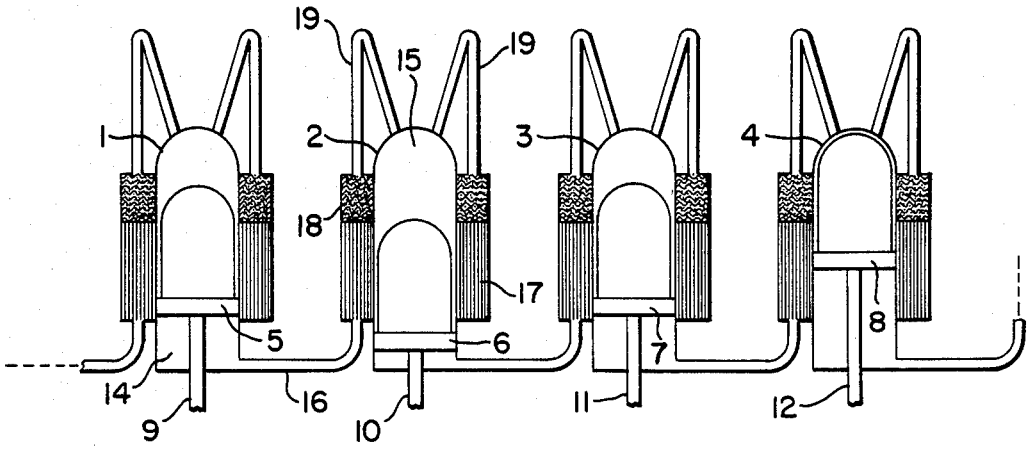
FIG. 1. (PRIOR ART)
FIG. 1 shows schematically and in vertical section four cylinders of a prior art hot gas engine.

Referring first to FIGS. 1–4 illustrating the prior art the reference numeral 1–4 designate four cylinders of a hot gas engine. Each cylinder 1–4 receives a piston 5–8 slidable in the respective cylinder and carries a respective piston rod 9–12 connected to a common crank shaft 13 (indicated by a straight dash dotted line in FIG. 2, but otherwise not shown).

The lower side of the piston 5 in the cylinder 1 limits a low temperature variable volume chamber 14 connected to a high temperature, variable volume chamber 15 limited by the upper side of the piston 6 in the cylinder 2. The connection comprises a cold gas connection duct 16, a cooler 17 surrounding the cylinder 2, a regenerator 18 also surrounding the cylinder 2 and a heater head 19 shown as tubes connecting the regenerator with the interior of the cylinder 2.

The cylinder 4 is connected to the cylinder 1 in a manner corresponding to the connections between the other cylinders so as to form a closed loop.

Figure 2:
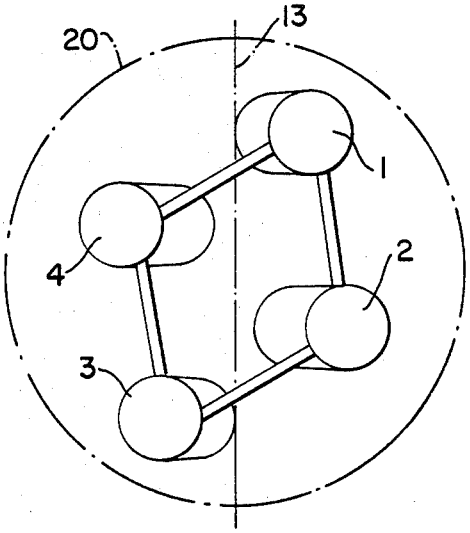
FIG. 2. (PRIOR ART)
FIG. 2 shows from above the cylinder configuration of an engine of the type shown in FIG. 1.
Figure 3:
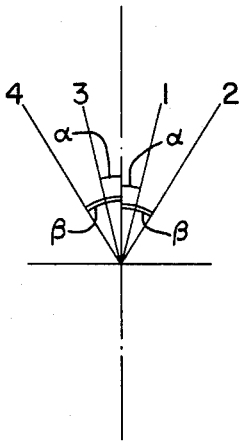
FIG. 3. (PRIOR ART)
FIG. 3 shows the angular displacement of the cylinders shown in FIG. 2.

In order to be able to connect all pistons 5–8 to the common crank shaft 13 the cylinders 1–4 are inclined at different angles. As shown in FIGS. 2 and 3 the cylinders 1 and 3 are inclined an angle $\alpha$(alpha) to each side of a vertical imaginary plan through the crank shaft axis. The cylinders 2 and 4 are inclined likewise through an angle $\beta$(beta) which is greater than $\alpha$. This configuration makes it possible to located the cylinder tops at almost equal distances from a dash-dotted circle 20 indicating the limits of a combustion chamber (not shown).

FIGS. 4*a*–4*d* show the relative angular distribution of the cranks of the crank shaft 13.

FIG. 4*a* shows the crank of the crank shaft 13 to which the piston in cylinder 1 is connected. FIG. 4*b* shows the relative displacement of the crank corresponding to the piston of cylinder 2. This piston should be 90 degrees displaced in the cylinder and this involves that the crank must be 90 degrees displaced plus the difference between the angles $\alpha$ and $\beta$, relative to the crank position in FIG. 4*a*. The crank position according to FIG. 4*c* corresponding to cylinder 3, is 90 degrees displaced relative FIG. 4*b* minus the angle $(\alpha+\beta)$ relative to that in FIG. 4*c*. Finally FIG. 4*d* shows a crank position which relative to that in FIG. 4*c*, is displaced 90° minus the angle $(\beta-\alpha)$.

As disclosed in the prior art referred to above more powerful engines (of corresponding cylinder bore and stroke) may be provided by increasing the number of cylinders to five or six by not more as the angular displacement between the movements of two pistons limiting a working gas charge should be kept within 60 and 120 degrees. A further increase in power heretofore has only been possible by mechanically connecting e.g. two four cylinder units, but this has involved the use of multiple heat supply systems.

Figure 5:
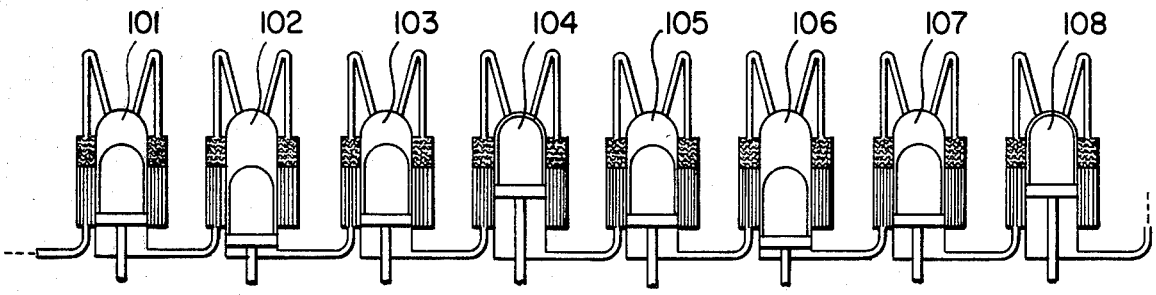
FIG. 5 shows diagrammatically (not mechanically) in a way corresponding to that of FIG. 1 the eight clyinders of an engine according to the present invention.
Figure 6:
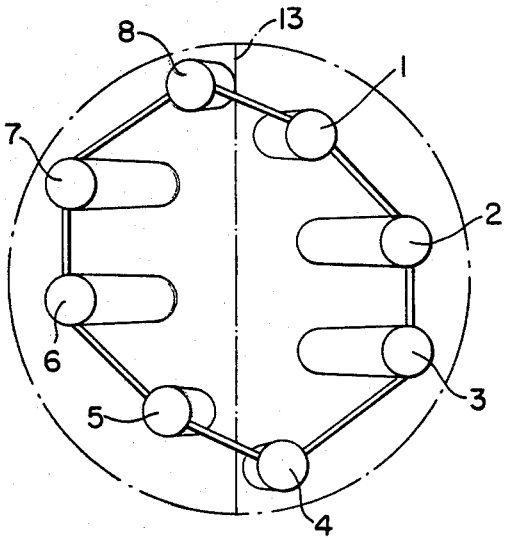
FIG. 6 shows from above the cylinder configuration an engine of the type shown in FIG. 5.
Figure 7:
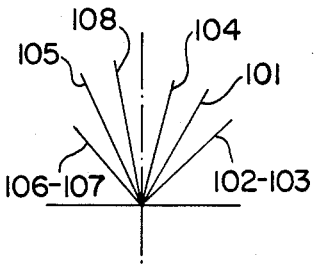
FIG. 7 shows the angular displacement of the cylinders shown in FIG. 5.

As shown in FIGS. 5 and 7 and in accordance with the present invention eight cylinders 101–108 are interconnected to form a loop—the cylinder 108 being connected to the cylinder 101 as indicated by dotted lines in FIG. 5. Each cylinder contains a piston which is 90 degress displaced relative the pistons in the neighboring cylinders. As a result, the pistons of the cylinders 101 and 105 perform identical movements and so do the pairs formed by the pistons of the cylinders 102 and 106, 103 and 107, and 104 and 108.

The pistons are all connected to a common crank shaft 13 and the cylinder axes are displaced relative an imaginary vertical plane through the axis of the crank shaft 13. The cylinders located near the ends of the crank shaft are less angularly displaced than the cylinders located near the middle of the crank shaft. As in the known type of engines this makes it possible to keep the cylinder tops within a combustion chamber having circular contour as seen from above.

Figure 4:
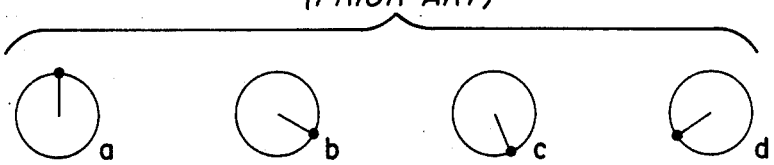
FIG. 4. (PRIOR ART)
FIGS. 4*a*–4*d* show the relative angular distribution of the cranks of a crank shaft to be used in an engine of the type shown in FIGS. 1 and 2.
Figure 8:
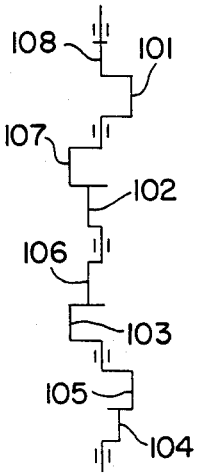
FIG. 8 shows schematically a crank shaft of an engine according to FIG. 6
Figure 9:
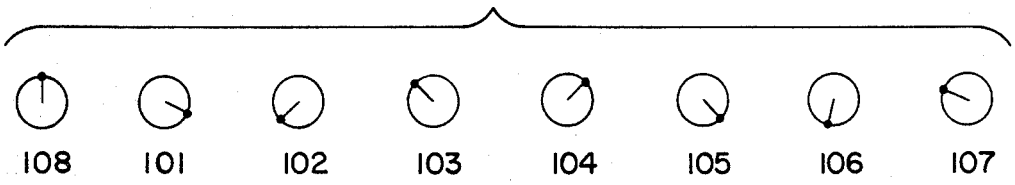
FIG. 9 shows the relative angular distribution of the cranks of the crank shaft shown in FIG. 8.

FIG. 7 shows the angles of the centerlines of the cylinders 101–108 and FIG. 8 shows the crank shaft 13 in a position corresponding to the crank positions illustrated in FIG. 9 which corresponds diagramatically (not mechanically) to the representation in FIG. 4.

I claim:

1. A hot gas engine of the type having a plurality of cylinders each of which contains a piston separating two working gas charges and being connected to a common crank shaft and in which each of the plurality of working gas charges is oscillated between variable volume chambers defined by the pistons and cylinders and of different temperatures so as to perform working cycles each of which consists of a compression in a low temperature variable volume chamber, a displacement to a high temperature variable volume chamber, an expansion in said high temperature chamber and a displacement back to said low temperature chamber, said engine further comprising said plurality of cylinders being greater than six;

all of said cylinders being series interconnected to form a single loop, a cold gas connecting duct, a cooler, a regenerator and a heater connecting each low temperature variable volume chamber to the high temperature variable volume chamber of a neighboring cylinder;

the cylinders and respective pistons being associated in pairs of two, the respective cranks of which on said common crankshaft being angularly displaced relative to one another to constrain the two pistons of each associated pair to perform identical simultaneous movement in their respective cylinders the pistons in each of said associated cylinder pair being at the same point in the working gas cycle of the respective cylinder.

2. A hot gas engine as claimed in claim 1 further comprising a single common heating device and wherein each of said cylinders has a heater head, said cylinders being angularly displaced relative to an imaginary vertical plane, said angular displacement being greater of the cylinders located near the middle of the crank shaft and smaller regarding the cylinders located at the crank shaft ends, and all of said heater heads extending into said common heating device.

3. A hot gas engine as claimed in claim 1 wherein said plurality of cylinders is eight cylinders.

4. A hot gas engine as in claim 2 wherein each of said cylinders is angularly displaced to one of at least 3 preselected displacement angles.

* * * * *